US005813562A

United States Patent [19]

Perkins

[11] Patent Number: 5,813,562

[45] Date of Patent: Sep. 29, 1998

[54] FLUENT CONTAINER

[75] Inventor: David W. Perkins, Hiawatha, Iowa

[73] Assignee: Plastic Systems, Inc., Des Moines, Iowa

[21] Appl. No.: 672,404

[22] Filed: Jun. 28, 1996

[51] Int. Cl.[6] ..... B65D 90/04

[52] U.S. Cl. ..... 220/495.05

[58] Field of Search ..... 220/465

[56] References Cited

U.S. PATENT DOCUMENTS

| | | | |
|---|---|---|---|
| 3,054,549 | 9/1962 | Humphrey | 220/465 |
| 3,089,622 | 5/1963 | Westlake, Jr. | 220/465 |
| 4,793,519 | 12/1988 | Voorhies, Jr. | 220/465 |
| 4,934,654 | 6/1990 | Linnemann | 220/465 |
| 5,042,682 | 8/1991 | Ritter | 220/465 |
| 5,143,278 | 9/1992 | Petriekis et al. | 220/465 |
| 5,353,982 | 10/1994 | Perkins et al. | 229/23 |

*Primary Examiner*—Stephen P. Garbe

*Attorney, Agent, or Firm*—Merchant, Gould, Smith, Edell, Welter & Schmidt

[57] ABSTRACT

An apparatus for containing a fluent material includes a fluent material containing bag with a valve; a container having a bottom and a discharge region beneath the bottom, the container containing the bag so that the valve drains the bag from the discharge region; and a pallet for supporting the container without interfering with the discharge region. Also, a method for using the apparatus by preparing to empty the container, which includes the steps of: removing a first knock-out portion; bending a bendable portion of the container into a receiving region of the pallet; removing a second knock-out portion; and pulling a portion of the valve through openings created by removing the first and second knock-out portions so that pad member holding the valve fits with the bendable portion of the container. In this way, a discharge region is formed beneath the bottom of the container from which the valve drains the bag.

8 Claims, 9 Drawing Sheets

FLUENT CONTAINER

FIELD OF THE INVENTION

The present invention is directed to a container, particularly, a multi-walled cardboard container having a drain which completely empties a bag liner containing fluent material.

BACKGROUND OF THE INVENTION

Cardboard or fiberboard containers for fluent material are known. The containers are commonly placed on a pallet before being filled. The containers commonly have a plastic or otherwise impervious lining bag with an opening at the top and a discharge fitting near the bottom of a sidewall which protrudes from an opening in or near the bottom of the sidewall. A cover is usually placed thereover. The container may or may not be further strapped and retained to the pallet.

Problems with known containers for fluent material include the difficulty in emptying the fluent material filled in the bag contained in containers. A conventional way of emptying the bag is to drain the bag through a discharge valve partially disposed outside the side of containers. With these conventional containers, a significant amount of fluent material is still left in the bag after draining the bag because the drain region is disposed in a higher position than the bottom of the bag.

U.S. Pat. No. 5,353,982 issued to Perkins, et al. provides one solution to this problem. The patent discloses a bottom extending drain by forming a drain region on the bottom of the container and pulling the discharge valve out of the drain region on the bottom of the container. One problem with the bottom extending drain is that in order to accommodate such bottom extending drain, the container's bottom has to provide an opening, and more importantly, the bottom extending drain is difficult to use because one has to reach underneath the bottom of the container to pull out the discharge valve from the bottom of the container and connect the discharge valve to a connecting pipe, or hose, etc.

Therefore, there is an unfilled need in the art for an apparatus for containing fluent material, which is able to completely drain the fluent material contained therein and is able to be easily installed and used. The present invention provides such an apparatus.

SUMMARY OF THE INVENTION

The present invention is directed to a multi-walled cardboard container having a drain which completely empties a bag liner retaining fluent material.

In one embodiment, a container apparatus for containing a fluent material comprises a fluent material containing bag with a valve; a container having a bottom member and means for creating a drain region beneath the bottom member, the container containing the bag so that the valve drains the bag from the region; and a pallet for supporting said container without interfering with the drain region creating means.

Further in one embodiment, the discharge region includes at least one bendable tab disposed on a bottom of the bottom member; a first opening disposed on a sidewall of the container proximate at the bottom of the bottom member; a second opening disposed on a side flap of the bottom member which is bendably connected to the bottom of the bottom member; and a V-notch disposed on the pallet proximate at said at least one bendable tab, such that a part of the discharge fitting is disposed in the discharge region which has a position lower than the bottom of the bottom member, so as to completely empty the fluent material in the bag.

Still in one embodiment, a container apparatus for containing large quantities of fluent material has a single multi-walled side member. The side member can be folded flat for pre-use storage. A flexible bag with a discharge fitting is folded into a bottom member. A cover member fits over the bottom member during pre-use storage. A pad member is disposed between the cover and bottom members and includes a securing mechanism for securing the discharge fitting. The discharge fitting has been secured to the securing mechanism prior to being given to a user. Therefore, it provides a quick-assembly, easy-to-use container. Further, since the pad member is stored with the flexible bag between the bottom member and the cover member, the securing mechanism does not take any additional pre-use storage space. To assemble for use, the multiwalled side member is opened so that the bottom member may be slid from top to bottom, preferably to rest on a pallet. The discharge fitting protrudes from an opening near the bottom of the bottom member and an opening near the bottom of the side member. The flexible bag is opened and its wall draped over the side member or, alternatively, its inlet fitting made available for receiving fluent material. When the bag is filled, the top is appropriately closed, and the cover member is placed thereover to complete the container.

Of further advantage, the container of the present invention includes a novel securing mechanism on the pad member. The pad member is formed from a piece of material and includes first and second proximately symmetrical sections connected to each other. Each section includes a locking member having a locking aperture, a receiving member bendable and extending from a first edge of the locking member, and a re-enforcing member bendable and extending from a second edge of the receiving member. The two locking apertures are alignable to each other, upon bending the first edge of the each locking member, to secure the discharge fitting with respect to the pad member and ultimately the container.

In an alternative embodiment, the pad member is a section which includes a locking member and a receiving member connected to each other. The locking member has a locking aperture, and the receiving member is disposed proximately vertical to the locking member so as to secure the discharge fitting in both horizontal and vertical directions with respect to the pad member and ultimately the container.

Further in one embodiment, the container includes first and second knock-out portions and a bendable portion. The discharge fitting or valve is secured to the pad member. The pallet includes a region for receiving the bendable portion without interfering with the bendable portion.

In preparing to empty a container containing a fluent bag filled with a fluent material, one removes the first knock-out portion; bends the bendable portion into the bendable portion receiving region of the pallet; removes the second knock-out portion; and pulls a portion of the valve through the first and second knock-out portions so that the pad member fits with the bendable portion.

The present invention achieves solutions to problems with the known art in a way which can completely empty the fluent material in the container bag. The present invention is discussed in more detail along with its various advantages in the detailed description which references the drawings.

BRIEF DESCRIPTION OF THE DRAWINGS

A better understanding of the construction and operational characteristics of a preferred embodiment(s) can be realized from a reading of the following detailed description, especially in light of the accompanying drawings in which like reference numerals in the several views generally refer to corresponding parts.

DETAILED DESCRIPTION OF THE PREFERRED EMBODIMENT

Figure 1:
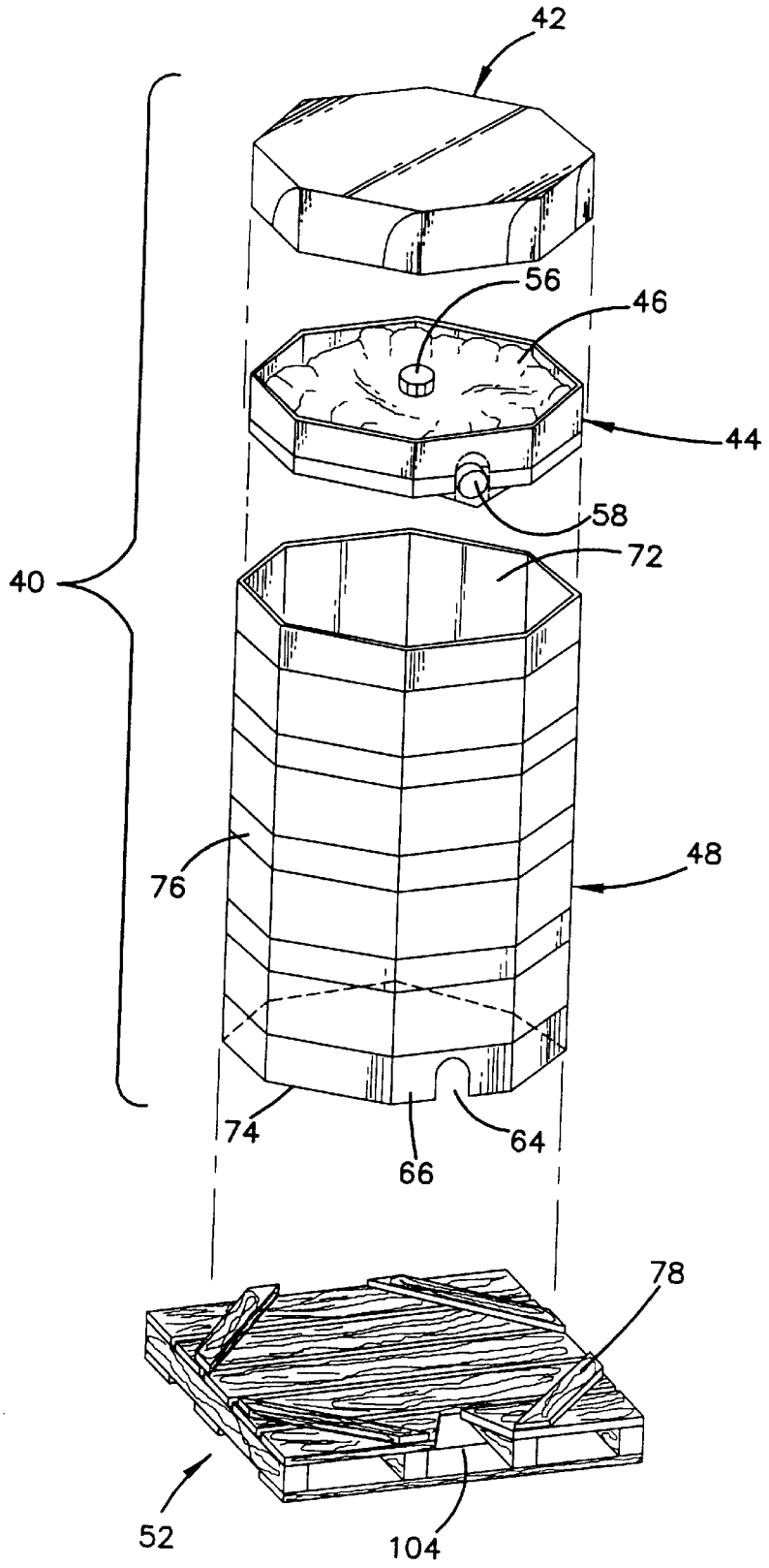
FIG. 1 is an exploded, perspective view of a container, in accordance with the principles of the present invention, with a pallet supported thereunder.

Referring now to the drawings wherein like and corresponding reference numerals are used for like or corresponding parts throughout the several views, there is shown in FIG. 1, an exploded, perspective view of a preferred embodiment of a fluent container 40 in accordance with the principles of the present invention. Container 40 includes a cover member 42, a bottom member 44, a flexible bag 46, a multi-walled side member 48, and a pad member 50, all preferably made of cardboard, except flexible bag 46 which is preferably made of a plastic or other flexible, fluid-impervious material. It is preferable to place container 40 on a pallet 52.

With reference to FIG. 1, cover member 42 is formed to fit over a top end 72 of side member 48. Bottom member 44 is formed to fit into a bottom end 74 of side member 48. Flexible bag 46 is foldable into bottom member 44. In assembly, after bottom member 44 with bag 46 disposed therein is pushed from the top end 72 through side member 48 and positioned proximate bottom end 74 of side member 48, cover member 42 is fitted over top end 72 of side member 48 so as to cover the top end of container 40.

Figure 2:
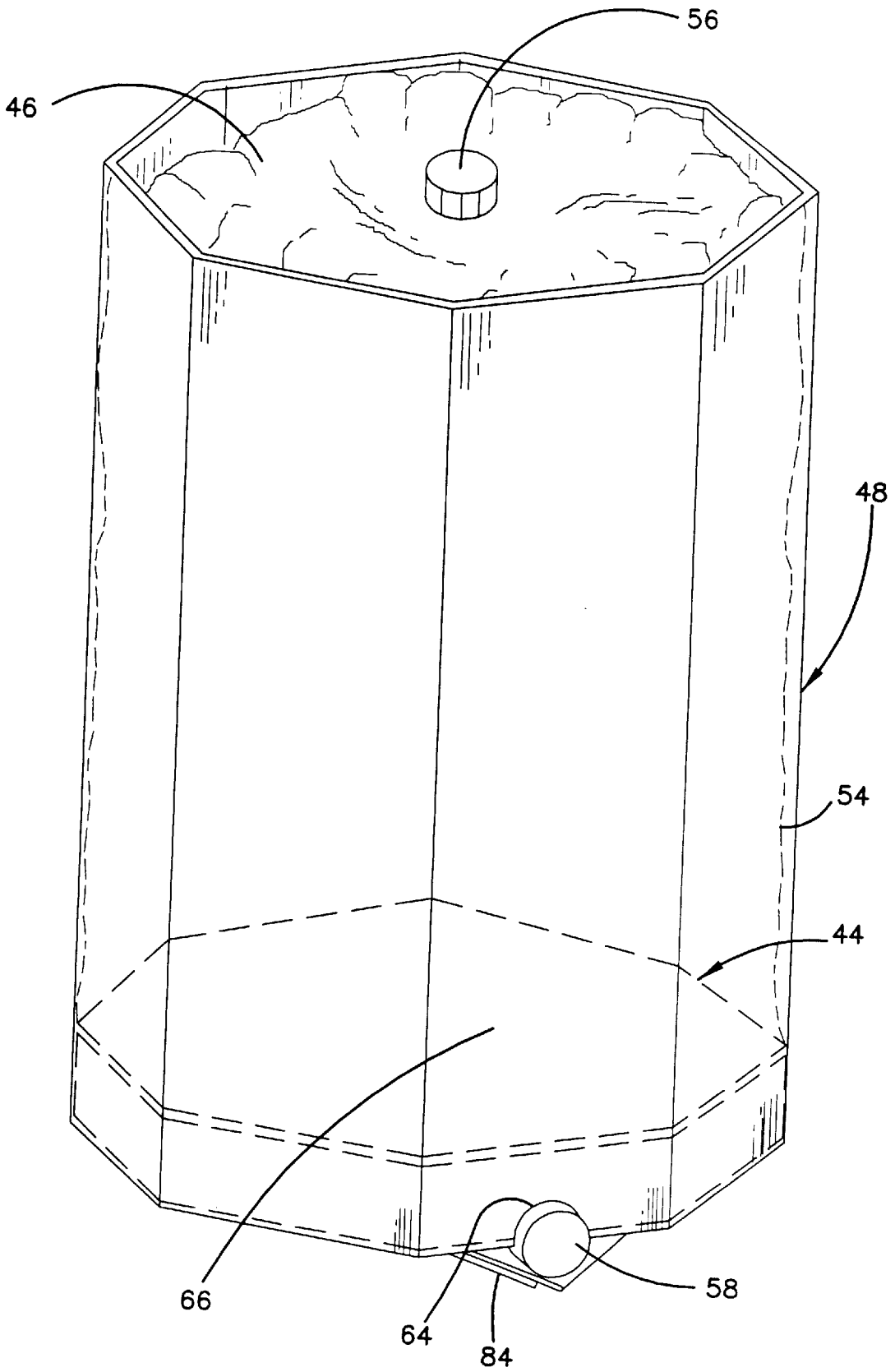
FIG. 2 is a perspective view of the container, except that a cover member is not shown.

In FIG. 2, bag 46, which can contain large quantities of fluent material, has a wall 54 and can have two fittings. At the top of bag 46, an opening or an inlet fitting 56 can be used to receive fluent material. When bag 46 is filled, opening or inlet fitting 56 is closed appropriately.

Figure 3:
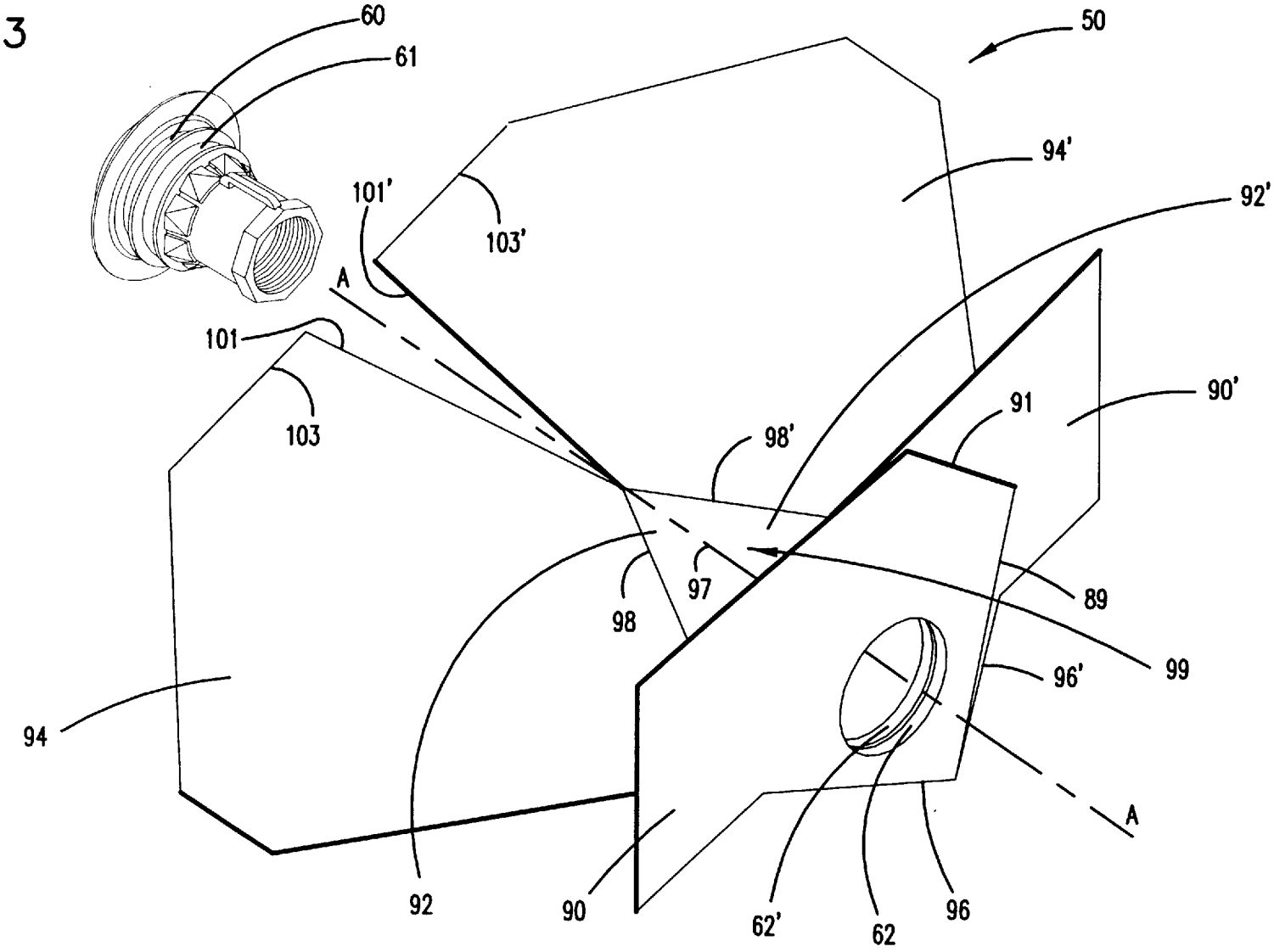
FIG. 3 is an exploded, perspective view of a discharge fitting and a pad member.
Figure 4:
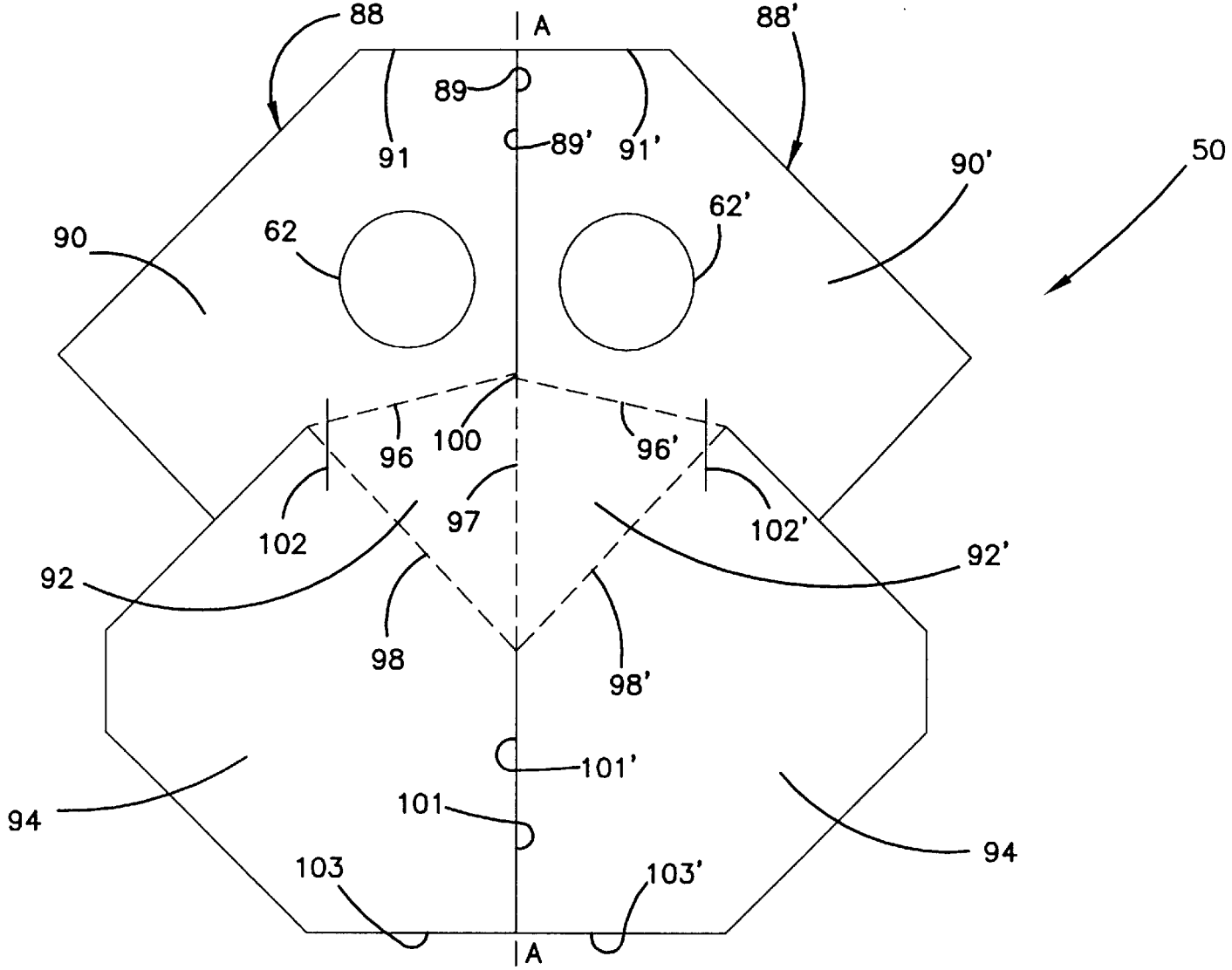
FIG. 4 is a plan view of the pad member in its flat, unbent position.
Figure 5:
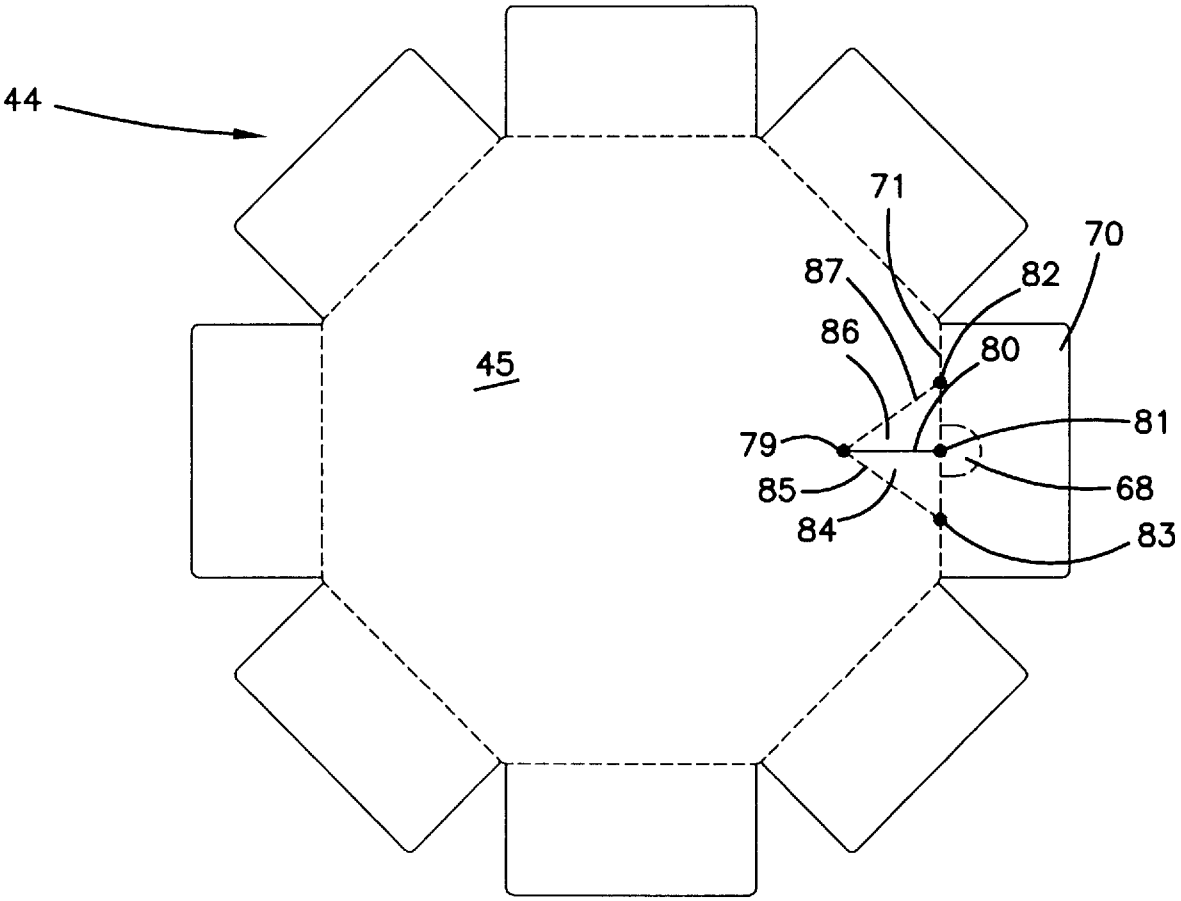
FIG. 5 is a plan view of the bottom member in its flat, unbent position.
Figure 6:
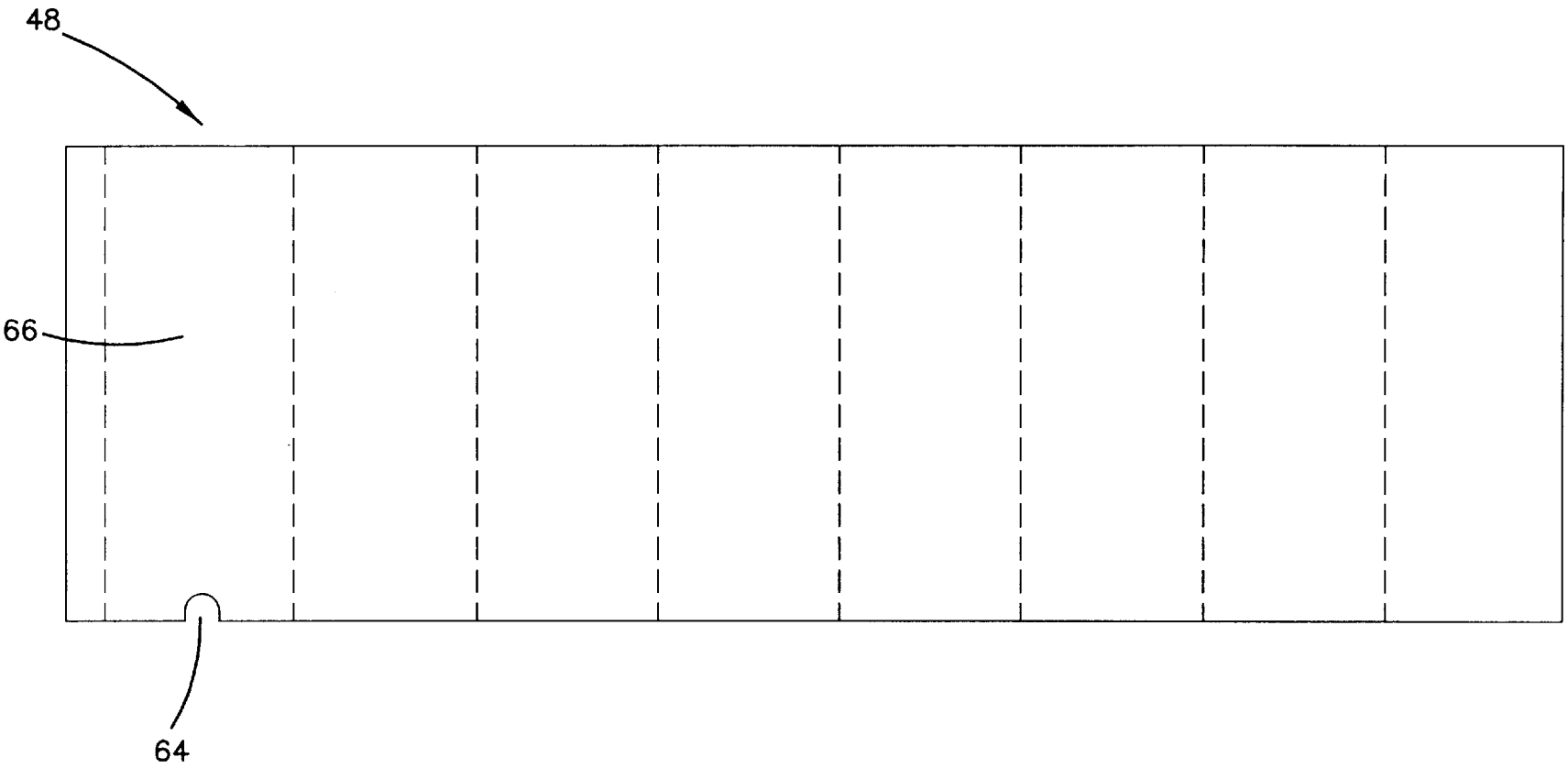
FIG. 6 is a plan view of the side member in its flat, unfolded position.

As shown both in FIGS. 1 and 2, bag 46 also has a discharge fitting 58 or valve. Discharge fitting 58 is disposed proximate the bottom of the side of bag 46. As shown in FIG. 3, discharge fitting 58 includes a first receiving portion 60 and a second receiving portion 61. First receiving portion 60 is generally cylindrical having a size for fitting snugly in locking apertures 62,62' of pad member 50 as shown in FIG. 4. Second receiving portion 61 is also generally cylindrical having a size for fitting snugly in an opening 64 disposed at substantially the bottom of one wall 66 of side member 48 as shown in FIG. 6 and in an opening 68 disposed proximate the bottom of a flap 70 of bottom member 44 as shown in FIG. 5. Discharge fitting 58 is pulled out of openings 64,68 and is secured therein when the container 40 is in use.

Opening 64 on side wall 66 of side member 48 is defined by a first portion which is removed before discharge fitting 58 protrudes therethrough. This removed first portion is often called a "knock-out." As shown in FIG. 1, opening 64 has an upside-down U shape. Opening 68 proximate the bottom of flap 70 of bottom member 44 is defined by a second portion which is removed before discharge fitting 58 protrudes therethrough. The removed second portion is also often called a "knock-out." Openings 68 and 64 preferably have the same shape. Accordingly, when container 40 is in use, before pulling out discharge fitting 58, the "knock-out" first and second portions are removed so as to form openings 64,68.

Referring to FIGS. 3–4, pad member 50 includes two generally symmetrical sections, a left section 88 and a right section 88', which are symmetrical along an axis A—A. Left section 88 has a multi-edge shaped locking member 90. Locking member 90 includes a first edge 89, a second edge 91 which is generally perpendicular to first edge 89, and a third edge 96 which is disposed on the opposite side of second edge 91 which forms an acute angle with respect to a parallel line of second edge 91 in a direction away from second edge 91. When pad member 50 is in the unbent position as shown in FIG. 4, first edge 89 is disposed along axis A—A, second edge 91 is generally disposed perpendicular to axis A—A, and third edge 96 is disposed oblique to axis A—A.

Likewise, right section 88' has a multi-edge shaped locking member 90'. Locking member 90' includes a first edge 89', a second edge 91' which is generally perpendicular to first edge 89', and a third edge 96' which is disposed on the opposite side of second edge 91' and has an acute angle with respect to a parallel line of second edge 91'. When pad member 50 is in the unbent position as shown in FIG. 4, first edge 89' is disposed along axis A—A, second edge 91' is generally disposed perpendicular to axis A—A, and third edge 96' is disposed oblique to axis A—A.

In addition, left and right locking members 90,90' each also includes an aperture 62,62', respectively. Apertures 62,62' are symmetrical to each other and disposed between second and third edges 91 and 96 and between second and third edges 91' and 96', but closer to the third edges 96,96', respectively.

As shown in FIG. 3, when pad member 50 is in a bent position to receive and secure discharge fitting 58, left and right locking members 90,90' of the corresponding left and right sections 88,88' are folded toward each other to the extent that the two apertures 62 and 62' are aligned with each other. Accordingly, first edges 89,89' are split apart from the axis A—A and axis A—A passes through the aligned apertures 62,62' as shown in FIG. 3. The aligned apertures 62,62' receive discharge fitting 58 and retain the same at its second receiving portion 61 as above discussed.

Further in FIG. 4, left section 88 includes a triangular shaped receiving member 92. Receiving member 92 has a first edge being a common edge with the third edge 96 of locking member 90, a second edge 97 which is disposed along axis A—A, and a third edge 98 which is connected between common edge 96 and second edge 97. Common edge 96 is oblique to second edge 97, and third edge 98 has an acute angle with respect to second edge 97.

Likewise, right section 88' includes a triangular shaped receiving member 92'. Receiving member 92' has a first edge being a common edge with the third edge 96' of locking member 90', a second edge being a common edge with second edge 97 of left receiving member 92 which is disposed along axis A—A, and a third edge 98' which is connected between common edge 96' and common edge 97. Common edge 96' is oblique to common edge 97', and third edge 98' has an acute angle with respect to common edge 97'.

As shown in FIG. 3, when pad member 50 is in a bent position to receive and secure discharge fitting 58, left and right receiving members 92,92' are bent downward and toward each other along the axis A—A so as to form a receiving region 99 between the left and right receiving members 92,92'. Receiving region 99, accordingly, accommodates a bottom part of discharge fitting 58 so as to provide a stable position for discharge fitting 58 in a horizontal level.

Additionally in FIG. 4, left section 88 includes a multi-edge shaped re-enforcing member 94. Re-enforcing member 94 has a first edge 101, a second edge 103 which is generally perpendicular to first edge 101, and a third edge being a common edge of third edge 98 of receiving member 92, which is disposed on the opposite side of second edge 103 and has an acute angle with respect to the opposite extension of first edge 101. When pad member 50 is in the unbent position as shown in FIG. 4, first edge 101 is disposed along axis A—A, second edge 103 is generally disposed perpendicular to axis A—A, and common edge 98 is disposed oblique to axis A—A.

Similarly, right section 88' includes a multi-edge shaped re-enforcing member 94'. Re-enforcing member 94' has a first edge 101', a second edge 103' which is generally perpendicular to first edge 101', and a third edge being a common edge of third edge 98' of receiving member 92', which is disposed on the opposite side of second edge 103' and has an acute angle with respect to the opposite extension of first edge 101'. When pad member 50 is in the unbent position as shown in FIG. 4, first edge 101' is disposed along axis A—A, second edge 103' is generally disposed perpendicular to axis A—A, and common edge 98' is disposed oblique to axis A—A.

As shown in FIG. 3, when pad member 50 is in a bent position to receive and secure discharge fitting 58, left and right re-enforcing members 94,94' of the corresponding left and right sections 88,88' are split apart from axis A—A and are disposed generally symmetrical to each other. As shown, left and right re-enforcing members 94,94' of the corresponding left and right sections 88,88' are bent downward at the common edges 98,98', respectively, and first edges 101,101' are split apart from axis A—A.

Further as shown in FIG. 3, the five common edges 96,96',97,98,98' are bendable between left locking member 90 and left receiving member 92, between right locking member 90' and right receiving member 92', between left receiving member 92 and right receiving member 92', between left receiving member 92 and left re-enforcing member 94, and between right receiving member 92' and right re-enforcing member 94'. To align the two apertures 62,62', locking members 90,90' are bent inwardly toward receiving members 92,92', and left locking member 90 lies over right locking member 90' as shown in FIG. 3, or vice versa whereby right locking member 90' can lie over left locking member 90. Due to the thickness of the fiberboard or cardboard material, an offset portion 100 is disposed along the axis A—A' at the corners of left and right receiving members 92,92' and left and right locking members 90,90' to help the bending of pad member 50 as shown in FIG. 4. The length of offset portion 100 can be varied according to the thickness of pad member 50.

As also shown in FIG. 4, left and right sections 88,88', while lying in a flat, unbent position, appear to be an "owl" shape which has two locking members 90,90' being "owl's " head, two apertures 62,62' being "owl's " two eyes, two receiving members 92,92' (or triangles) being "owl's " beak, and two re-enforcing members 94,94' being part of "owl's " body. It will be appreciated that other shapes, designs, or embodiments in accordance with the principles of the present invention can be used.

Further in FIG. 4, re-enforcing tapes 102,102' are disposed about two symmetrical common corners of locking member, receiving member, and re-enforcing member. Tapes 102,102' are generally disposed parallel to axis A—A so as to reduce wear and tear caused by the bending therebetween. It can be any type of tape. One example is the tensile filament tape made by 3M Company (located in St. Paul, Minn., U.S.A.)

FIG. 5 shows a plan view of bottom member 44 in its flat, unbent position. Bottom member 44 has a bottom 45 and a plurality of flaps. Flaps are bent upwardly along the edges of bottom 45 to a generally vertical position with respect to bottom 45 and are held in place by re-enforcing tapes, such as 3M's tensile filament tape.

As discussed above, one of the flaps, flap 70, includes the second knock-out portion which is to form opening 68 before discharge fitting 58 is pulled out of bottom member 44. In use, flap 70 bends upwardly along a bending edge 71 of bottom 45. Opening 68 has an inverted U shape with the opening of the U shape being disposed on ending edge 71 proximate the middle of the bending edge 71.

As further shown in FIG. 5, bottom 45 is cut from a point 79 by a line 80 which is vertical to bending edge 71 to a point 81 at the opening of U-shaped opening 68. Further, the bending edge 71 is cut from point 81 along bending edge 71 in opposite directions to a point 82 and a point 83 on both sides of line 80, respectively. Accordingly, two bending tabs 84,86 are formed generally symmetrical on two sides of line 80. Bending tab 84 is bendable along a bending line 85 defined between point 79 and 83. Similarly, bending tab 86 is bendable along a bending line 87 defined between point 79 and 82. Bending tabs 84,86 on bottom 45 and opening 68 on flap 70, thus, form an area to accommodate receiving members 92,92' of pad member 50 by downwardly bending tabs 84,86 and retaining discharge fitting 58 by removing the second knock-out portion and pulling discharge fitting 58 out to be retained in opening 68.

In addition, container 40 preferably rests on pallet 52. Cleats 78 are securely mounted on pallet 52 so as to maintain container 40 in a fixed place by retaining bottom member 44. As illustrated in FIG. 1, it is preferable to mount four cleats 78 approximately at each of the four corners of pallet 52 so as to fit the octagonal shape of container 40 such that every other edge of octagon contacts one of cleats 78. In FIG. 1, a V-notch 104 is cut-out between two cleats so as to provide a clearance for bending tabs 84,86 of bottom member 44 and locking members 90,90' of pad member 50. The center of pallet 52 can be fully used to support container 40, while V-notch 104 provides an area for discharge fitting 58 so that discharge fitting 58 can be pulled out from a position having a portion lower than bottom 45 of bottom member 44 so as to empty the fluent material contained in bag 54.

Additionally in FIG. 1, cover member 42 has a top having sufficient size to fit over first end 72 of side member 48. Cover member 42 has flaps extending downwardly from the top. The flaps are glued together in a way known to those skilled in the art. When cover member 42 fits onto side member 48, these flaps extend downwardly from the top outside of and along the walls of side member 48.

Figure 9:
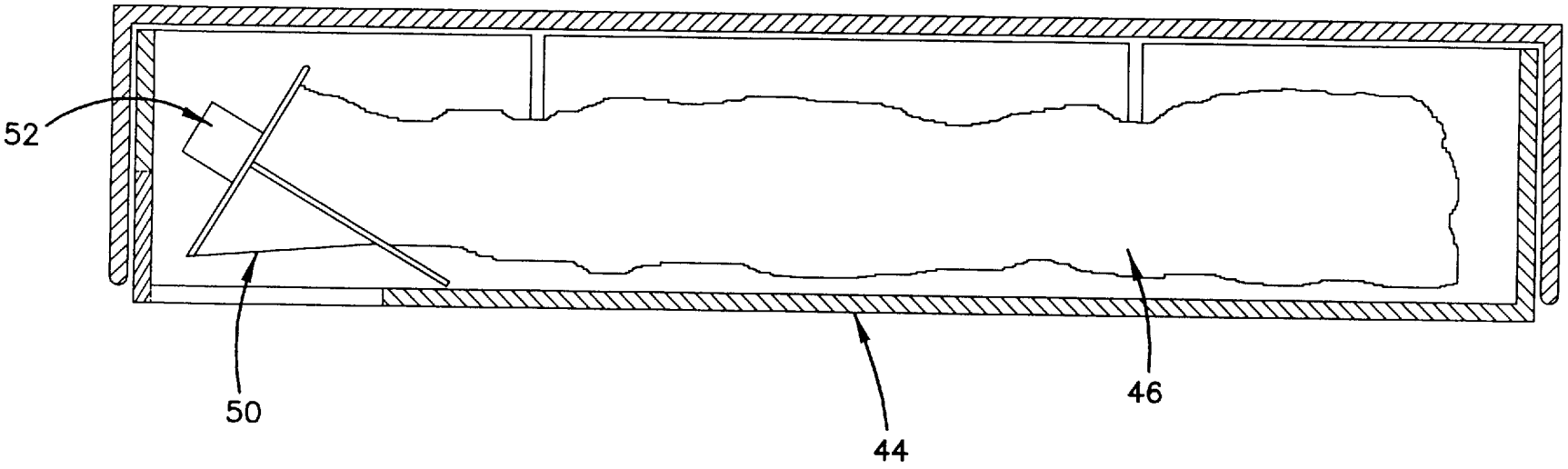
FIG. 9 is a cross-sectional view of the flexible bag, with its discharge fitting secured to the pad member, being stored between the cover and bottom members during pre-use storage.

In pre-use, pad member 50 is fixedly secured to discharge fitting 58 by bending the two sections 88,88' toward each other so as to align the two apertures 62,62' together and by inserting first receiving portion 60 of discharge fitting 58 into the aligned locking apertures 62,62'. The bent sections 88,88' tend to recover from the bent positions thus fixedly securing discharge fitting 58 to apertures 62,62' and ultimately to pad member 50. Prior to use, fluent bag 46, as well as discharge fitting 58 and pad member 50 are stored between cover member 42 and bottom member 44 as shown in FIG. 9. The pre-stored discharge fitting 58 and pad member 50 often travel inside bottom member 44 and cover member 42 such that discharge fitting 58 of fluent bag 46 is pre-secured and is ready-to-use.

Figure 10:
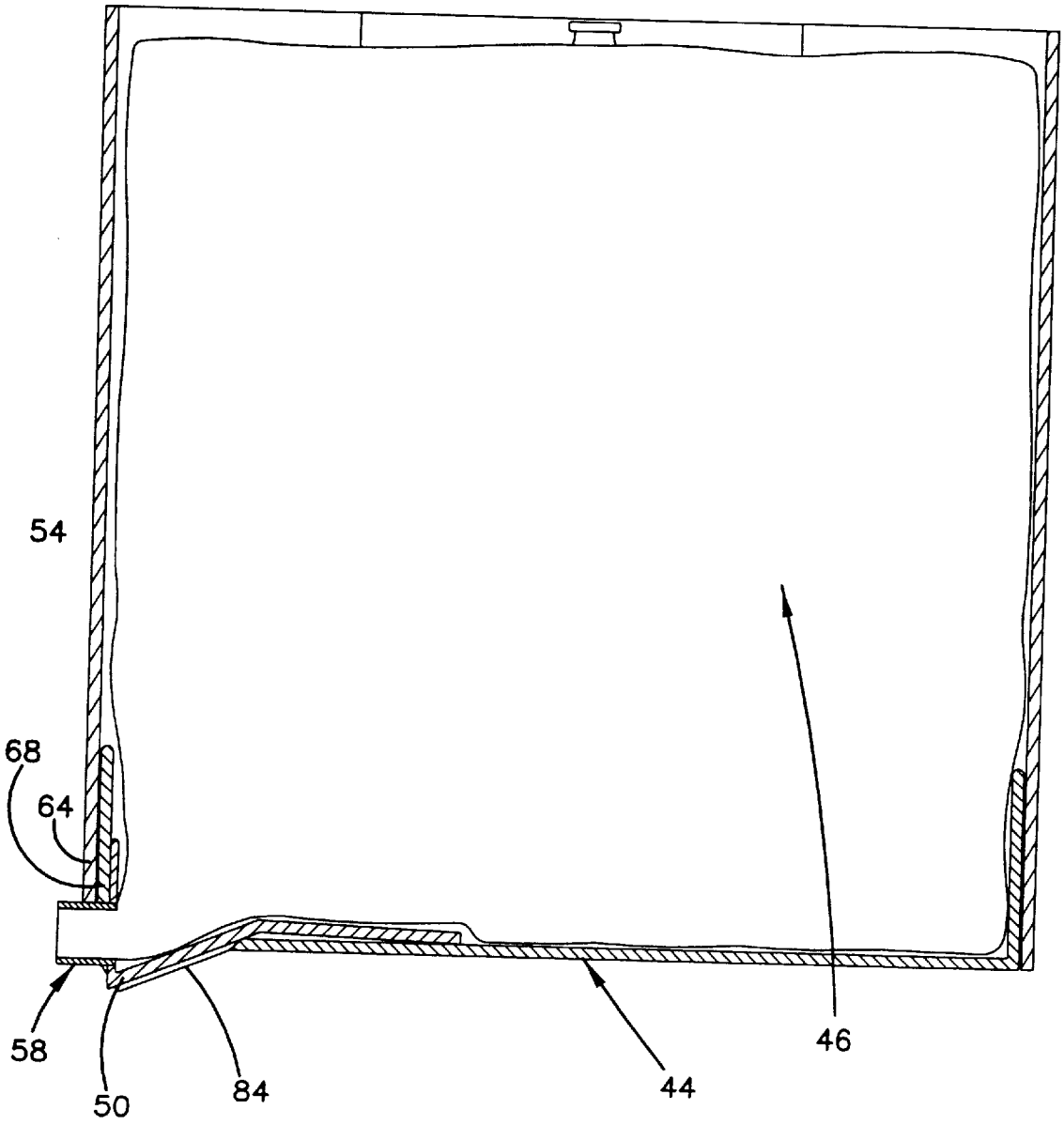
FIG. 10 is a cross-sectional view of the flexible bag containing fluent material having its discharge fitting and pad member of FIG. 9 partially pull out of a drain forming region when the container is assembled.

In use as shown in FIG. 10, cover member 42 is removed from a position of fitting over bottom member 44. The multi-walled, flattened side member 48 is expanded to open first end 72 and second end 74. Bottom member 44 containing bag 46 is slid inside and along multi-walled side member 48 until pad member 50 and its secured discharge fitting 58 reach the second end 74 of side member 48. As assembled, container 40 is placed on pallet 52 so that the knock-outs for openings 64, 68 are centered on V-notch 104.

After bag 46 has been filled and it is desired to empty it, first and second knock-out portions are removed to form opening 68 on bottom member 44 and opening 64 on side member 48. The assembling person then reaches through openings 64,68 in bottom member 44 and pulls discharge fitting 58 towards openings 64,68 while positioning discharge fitting 58 and pad member 50 downward into a discharge region generally formed by tabs 84,86 of bottom member 44, openings 64,68, and V-notch of pallet 52 to the extent that the second receiving portion 61 of discharge fitting 58 is retained by openings 64,68. As a result, discharge region and a bottom part of discharge fitting 58 is disposed in a position lower than the bottom 45 of bottom member 44. Tabs 84,86 are opened downwardly to receive pad member 50. In this way, a trough is formed into which fluent drains so that the fluent material contained in bag 54 can be fully emptied. It is appreciated that the discharge region can be constructed or configured in alternative suitable ways to receive the discharge fitting 58 in a position lower than the bottom of the container 40 so as to empty the fluent material in the fluent containing bag.

Figure 7:
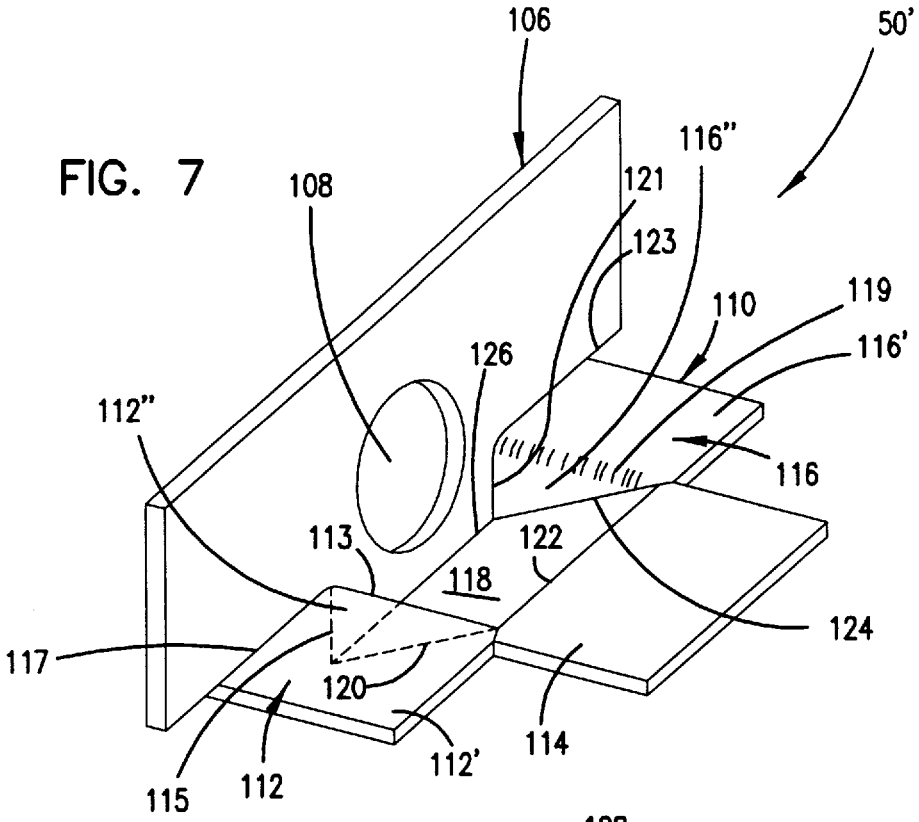
FIG. 7 is a perspective view of a first alternative embodiment of the pad member in its bent position.

FIG. 7 shows a first alternative embodiment of pad member 50'. Similarly, pad member 50' includes a locking member 106 having an aperture 108 and a receiving member 110. Receiving member 110, which is generally vertically connected to locking member 106, includes first, second, and third flap members 112,114,116 and a slope member 118. Slope member 118 and three flap members 112,114,116 define a space or clearance to accommodate discharge fitting 58. Slope member 118 has first, second, third, and fourth edges 120,122,124,126, respectively. Flap member 114 is bent from second edge 122 to a substantially horizontal position which is vertical with respect to locking member 106, while flap members 112,116 are bent into two sections 112',112" and 116',116", respectively. Section 112" is bent from first edge 120 into a position vertical to both locking member 106 and flap member 114 and is disposed in a space between locking member 106 and flap member 114. Section 112' extends from section 112" at their common edge 113 into a substantially horizontal position with respect to flap member 114. Sections 112'112" intersect into locking member 106 at two relatively vertical edges 115,117. As shown in FIG. 7, section 112" has generally a triangle shape defined by edges 120,113,115. Likewise, section 116" is bent from third edge 124 into a position vertical to both locking member 106 and flap member 114 and is disposed in a space between locking member 106 and flap member 114.

Section 116' extends from section 116" at their common edge 119 into a substantially horizontal position with respect to flap member 114. Accordingly, sections 116',116" intersect into locking member 106 at two relatively vertical edges 121,123. As shown in FIG. 7, section 116" has generally a triangle shape defined by edges 121,123,124. As a result, locking member 106 intersects with receiving member 110 at edges 117,115,126,121,123. Preferably, locking member 106 and receiving member 110 are connected together along edges 117,115,126,121,123 by glue. It will be appreciated that other connecting means can be used, such as by means of taping. Similar to the above discussed embodiments, discharge fitting 58 can be pre-secured in aperture 108 of locking member 106 in pre-use storage. It is understood that tabs 84, 86 are appropriately formed to receive the discharge region of pad member 50'.

Figure 8:
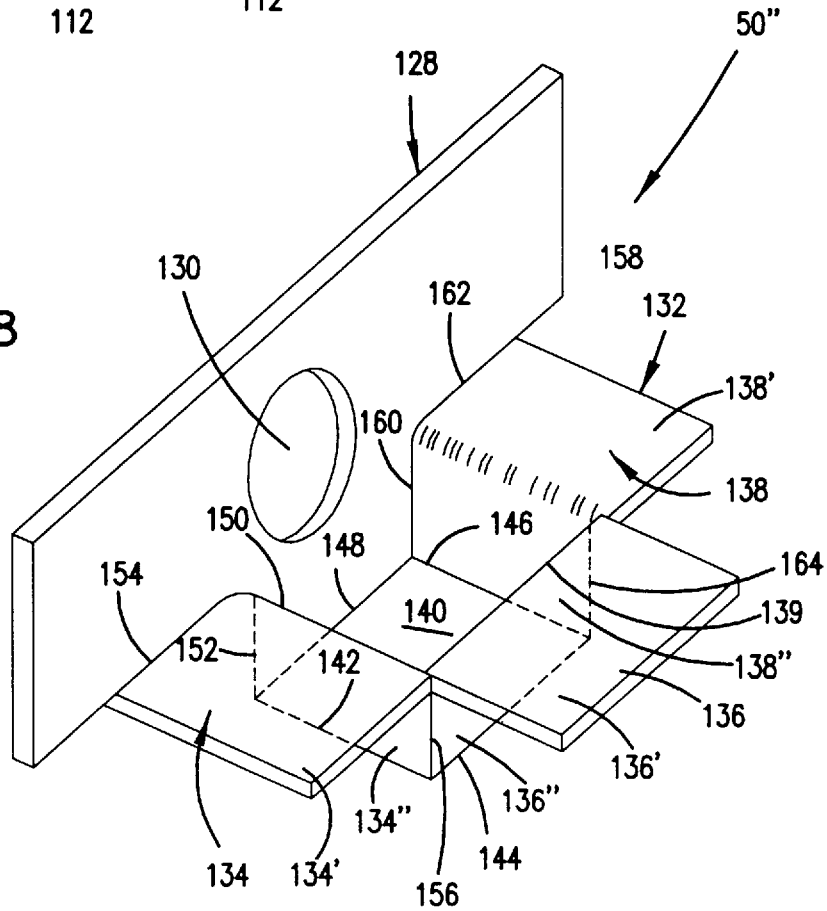
FIG. 8 is a perspective view of a second alternative embodiment of the pad member in its bent position.

FIG. 8 shows a second alternative embodiment of pad member 50". Similarly, pad member 50" includes a locking member 128 having an aperture 130 and a receiving member 132. Receiving member 132, which is generally vertically connected to locking member 128, includes first, second, and third flap members 134,136,138 and a flat bottom member 140. Flat member 140 and three flap members 134,136,138 define a space or clearance to accommodate discharge fitting 58. Flat bottom member 140 has first, second, third, and fourth edges 142,144,146,148, respectively. Flap members 134,136,138 are bent into two sections 134',134", 136',136", and 138'138", respectively. Section 134" is bent from first edge 134 into a position both vertical to flat bottom member 140 and locking member 128 and is disposed in a space between locking member 128 and flap member 136. Section 134' extends from section 134" at their common edge 150 into a substantially horizontal position. Accordingly, sections 134',134" intersect into locking member 128 at two relatively vertical edges 152,154. As shown in FIG. 8, section 134" has generally a rectangular shape defined by edges 142,150,152,156. Likewise, section 136" is bent from second edge 144 into a position vertical to flat bottom member 140 and parallel to locking member 128. Section 136' extends from section 136" at their common edge 139 into a substantially horizontal position. Accordingly, sections 136',136" intersect into flap member 134 at the edge 156. As shown in FIG. 8, section 136" has generally a rectangular shape defined by edges 139,144,156, 164. Likewise, section 138" is bent from third edge 146 into a position vertical to both locking member 128 and flat bottom member 140 and is disposed in a space between locking member 128 and flap member 136. Section 138' extends from section 138" at their common edge 158 into a substantially horizontal position. Accordingly, sections 138', 138" intersect into locking member 128 at two relatively vertical edges 160,162. Sections 136',136" intersect into flap member 136 at the edge 164. As shown in FIG. 8, section 138" has generally a rectangular shape defined by edges

146,158,160,164. As a result, locking member 128 intersects with receiving member 132 at edges 154,152,148,160,162. Preferably, locking member 128 and receiving member 132 are connected together along edges 154,152,148,160,162 by glue. It will be appreciated that other connecting means can be used, such as by means of taping. Similar to the above discussed embodiments, discharge fitting 58 can be pre-secured in aperture 130 of locking member 128 in pre-use storage. Likewise, it is understood that tabs 84, 86 are appropriately formed to receive the discharge region of pad member 50".

Thus, the preferred embodiment of the present invention has been described in detail. It is to be understood, however, that even though numerous characteristics and advantages of the present invention have been set forth in the foregoing description, together with details of the structure and function of the invention, the disclosure is exemplary and illustrative only, and changes may be made in detail, especially in matters of shape, size and arrangement of parts within the principles of the invention to the full extent indicated by the broad general meaning of the terms in which the appended claims are expressed.

What is claimed is:

1. Apparatus for containing a fluent material, comprising:

a fluent material containing bag with a discharge fitting;

a container having a bottom member forming a container bottom for said container, said bottom member having a bottom and a side flap bendably connected to the bottom, said bottom of said bottom member including a bendable tab, said container having a sidewall with a first opening disposed on the sidewall proximate the bottom member, said side flap including a second opening, said discharge fitting being received in said first and second openings, said container also having means for creating a discharge region beneath said container bottom, said container containing said bag so that said discharge fitting drains said bag from said discharge region; and a pallet supporting said container without interfering with said discharge region creating means, said pallet including a V-notch proximate said bendable tab, such that when said bendable tab is bent into the V-notch a part of the discharge fitting is disposed in the discharge region which has a position lower than the bottom of the bottom member, so as to completely empty the fluent material in the bag.

2. A container apparatus, comprising:

a side member with a plurality of walls, said side member having open first and second ends;

a cover member having a top which extends across the first end of the side member;

a flexible bag with a discharge fitting, the discharge fitting having a receiving portion;

a bottom member having a bottom which extends across the second end of the side member, the bottom member including a downwardly bendable flap; and a pad member, the pad member being detachably connected to the receiving portion of the discharge fitting, wherein the pad member is formable from a piece of material and includes a pair of proximate sections, each section including a locking member having a locking aperture and a first edge, the locking apertures being alignable to each other, upon bending the first edge of each locking member, to secure the receiving portion of the discharge fitting with respect to the pad member, said pad member fitting against said bendable flap of said bottom member.

3. A container apparatus according to claim 2, wherein the pad member further includes a receiving member bendable and extending from the first edge of the locking member, and a re-enforcing member bendable and extending from a second edge of the receiving member.

4. A container apparatus according to claim 2, wherein a wall of the side member includes a first removable portion defining a first opening, the first opening being alignable to the two locking apertures so as to retain the discharge fitting with respect to the side member.

5. A container apparatus according to claim 4, wherein said bendable flap of the bottom member includes a second removable portion defining a second opening, the second opening being alignable to the locking apertures so as to retain the discharge fitting with respect to the bottom member.

6. A container apparatus according to claim 3, wherein each of said locking members has a third edge, the third edges of the locking members being separably engageable with each other when the locking members are in an unbent position whereby the third edges define a symmetrical axis of the pad member.

7. A container apparatus according to claim 6, wherein the two receiving members are bendable with respect to each other along the symmetrical axis of the pad member.

8. A container apparatus according to claim 6, wherein each of said re-enforcing members has a fourth edge, the fourth edges of the two re-enforcing members being separably engageable with each other along the symmetrical axis of the pad member when the re-enforcing members are in an unbent position.

* * * * *